US009623997B2

(12) United States Patent
Minasian

(10) Patent No.: US 9,623,997 B2
(45) Date of Patent: Apr. 18, 2017

(54) MATERIAL SORTING AND FILLING DEVICE AND METHODOLOGY FOR USE WITH PLASTIC BAGS INCORPORATING INTERLOCKING STRIP FASTENERS

(71) Applicant: Martin Joseph Minasian, Santa Barbara, CA (US)

(72) Inventor: Martin Joseph Minasian, Santa Barbara, CA (US)

( * ) Notice: Subject to any disclaimer, the term of this patent is extended or adjusted under 35 U.S.C. 154(b) by 149 days.

(21) Appl. No.: 14/685,822

(22) Filed: Apr. 14, 2015

(65) Prior Publication Data

US 2015/0307215 A1 Oct. 29, 2015

Related U.S. Application Data

(60) Provisional application No. 61/982,962, filed on Apr. 23, 2014.

(51) Int. Cl.

| | |
|---|---|
| ***B65B 37/00*** | (2006.01) |
| ***B65C 5/00*** | (2006.01) |
| ***B65B 39/06*** | (2006.01) |
| ***B65B 67/12*** | (2006.01) |
| ***B65B 5/10*** | (2006.01) |
| *B65B 39/00* | (2006.01) |

(52) U.S. Cl.

CPC ..... *B65C 5/00* (2013.01); *B65B 5/101* (2013.01); *B65B 5/103* (2013.01); *B65B 39/06* (2013.01); *B65B 67/1205* (2013.01); *B65B 2039/009* (2013.01); *B65B 2067/1294* (2013.01)

(58) Field of Classification Search

CPC ..... B65B 39/06; B65B 2039/009; B65B 2067/1294; B65B 5/103

USPC ..... 141/237, 240, 247

See application file for complete search history.

(56) References Cited

U.S. PATENT DOCUMENTS

| | | | | |
|---|---|---|---|---|
| D450,129 | S * | 11/2001 | Wentz | B65B 39/06 D24/227 |
| 2013/0074456 | A1* | 3/2013 | Hradisky | B65B 39/06 53/473 |
| 2015/0096644 | A1* | 4/2015 | Lee | B65D 47/066 141/1 |

* cited by examiner

*Primary Examiner* — Jason K Niesz

(57) ABSTRACT

An extensible device supporting a multidimensional sorting method for the concurrent sorting and filling of lightweight materials into plastic bags, with interlocking strip fasteners. The device comprising a planar array of at least one ribbed tubular insert, integrated vertically onto a thin plate, and supported above a work surface. Each ribbed tubular insert having an exterior surface comprising a plurality of ridges and grooves circumscribing the perimeter of the insert about its elongated axis, and containing a smooth-wall hollow core, with a top opening for loading, and a bottom opening for discharging at a distal end. The tongue and groove of the bag strip fastener securely engages with the insert ridges and grooves, thereby allowing the bags and associated fill material to be vertically suspended above the work surface. The array of inserts and bags are labeled similarly to associate the selected sorting criteria with the applicable bag contents.

8 Claims, 12 Drawing Sheets

MATERIAL SORTING AND FILLING DEVICE AND METHODOLOGY FOR USE WITH PLASTIC BAGS INCORPORATING INTERLOCKING STRIP FASTENERS

CROSS REFERENCE TO RELATED APPLICATIONS

This application claims the benefit of PPA Ser. No. 61/982,962, filed Apr. 23, 2014 by the present inventor, which is incorporated by reference.

FEDERALLY SPONSORED RESEARCH

Not Applicable

SEQUENCE LISTING

Not Applicable

BACKGROUND

Plastic storage bags, which incorporate interlocking strip fasteners ("zip lock" bags), are a consumer staple and in wide use for a myriad of business and household applications. These types of bags are re-sealable, and provide a closure mechanism that is typically secure and affords an airtight and moisture proof seal. The strip fastener inherent design characteristics and associated attributes make these bags an ideal storage solution for items such as food, medications, and all assortments of small hardware items. Filling these bags is usually a manual process, which requires the mouth of the bag to be held in an open position while the bag is filled. Keeping these bags open during the initial stages of a bag filling process has long been recognized as a problem. Without external or internal structural support to hold the bag open, a user must either hold the bag open with one hand while filling with the other, or find an assistant to hold it open. In applications where multiple bags must be filled, the effort can result in a serial, labor intensive and time-consuming process. The process is further complicated in cases where the fill material must be sorted into different bags concurrent with the filling process.

Several types of filling devices for small plastic bags have been proposed. These are targeted to filling and sorting small lightweight items such as medications. Systems for labeling and storing plastic bags containing medications for subsequent dispensing have also been proposed. These devices and systems include:

1) Mosley (U.S. Pat. No. 5,752,371—1998) is a bag loading device for sorting and storing in bags various medicaments and the like having a plurality of independent pivotal elongated funnels arranged longitudinally in two parallel rows. The disadvantages of the Mosley devise include its complexity and size. It requires multiple moving parts to support the engagement and disengagement of the bags, and a separate variable height bar to support the bottom of the bags. In contrast to this invention, its complexity will result in higher production costs, and the number of steps required to operate the devise will result in more time required to fill the equivalent number of bags. In addition, its size and projected footprint is large, relative to the size and number of bags it can handle at one time.

2) Gibson (U.S. Pat. No. 6,761,010—2004) is a medication organizing system for allowing patients to prepare hermetically sealed dosage packages to set up their medication regime for a given period of time. The device includes seven hoppers to allow the patient to prepare a set of hermetically sealed medication packages for a given time for each day of the week. After being filled, each package in the set of seven packages is hermetically sealed simultaneously by loading the set into a sealing unit and pulling a lever. This organizing system is similar to Mosley, in that it suffers the same size, complexity and cost issues. In addition, it is limited to seven filling hoppers and is targeted to creating hermetically sealed one-time use bags, as opposed to re-sealable/re-useable bags.

3) Holmberg (U.S. Pat. No. 6,293,403—2001) is a vitamin organizing, storing and dispensing system to organize, store and dispense a plurality of tablets in a predetermined therapeutic regime comprising a plurality of sets of separate packets corresponding to the days of the week or the dates of the month configured to store at least one tablet therein wherein each set of separate packets comprises a subset of the packets corresponding to the time of day or date the plurality tablets for the corresponding day or date are to be administered and a packet organizer to arrange the sets and subsets of packets sequentially by day or date and time of day or date for each corresponding day or date for selectively dispensing and consumption of the appropriate tablet or tablets at the proper time and day or date. While this invention provides a system for labeling and organizing bag contents for storage and subsequent use (dispensing), it assumes that the bags have been previously filled. It does not address sorting or filling medications into the appropriate bags.

4) Ganti (U.S. Pat. No. 8,132,672—2012) is a flexible, compact, and securely closed pill pouch pocket packet folder designed for secure handling, has multiple pockets, containing securely stored pouches for easy and orderly storing and retrieving of pills or similar small items, as when needed, for home or travel. Like Holmberg, this invention provides a system for organizing bag contents for storage and subsequent use (dispensing), it does not address sorting medications into the appropriate bags during the filling process.

SUMMARY

This invention relates to a device and methodology for sorting and filling lightweight materials into re-sealable plastic bags, which incorporate interlocking strip fasteners. In one embodiment, the device consists of multiple ribbed tubular inserts, which are vertically integrated into a rectangular plate, with each insert having a tapered opening accessible from the top-side of the plate, and a corresponding opening on the underside of the plate for discharging material into an attached bag. The plate's tapered opening and corresponding ribbed inserts act as a conduit for the fill material. The ribbed tubular inserts provide the means for holding the mouth of the bag in an open position, and simultaneously suspending the bag in a vertical orientation in order to provide hands-free bag support, while filling material into the bags. The insert ribs, comprising alternating ridges and grooves, engage with the tongue and groove of the bag's strip fastener, thereby providing the means for the bag's support and requiring no additional support aids. The plate is supported by four elongated support members, and elevated to a height that allows the bottom of the suspended bags to vertically clear the working surface. This affords unfettered access to each bag's available fill space, and vertical clearance room to remove the bags from the inserts once filled.

The inserts are arranged as a two-dimensional array on the plate, organized into rows and columns, in order to aid in the concurrent sorting and filling of materials into multiple bags. The array rows and columns on the plate and the bags are labeled in a consistent fashion in order to identify and associate the fill material in each bag according to its specified sorting characteristics.

This invention is directed at applications where the need exists to sort and fill small, lightweight items, with varying attributes and sorting criteria, into multiple plastic storage bags. Example applications include, but are not limited to: Medications and vitamins in the form of pills or powders sorted by day and time; Craft and sewing items organized by shape and color; And hardware fasteners grouped by size and function. Thus the applications are as many and varied as are the materials and sorting criteria. In addition, the device configurations and methodology are extensible to address multidimensional sorting applications.

Advantages

In contrast to the foregoing devices, which involve multiple moving parts, and are large in size relative to the function they perform, this invention affords the following advantages:

- Single piece construction of integrated plate and inserts, with no moving parts required.
- Lends itself to very low cost production methods such as injection molding, using pharmaceutical and food safe plastics
- Lightweight and projects a small footprint relative to number and size of bags it supports.
- Pivoting support members adjust vertical clearance height to accommodate bags of various lengths and fold flat for convenient storage in drawers or other small spaces.
- Inserts allow filled bags to vertically suspend freely, not requiring any additional support aids
- Uncomplicated, simple to use, with efficient placement and removal of bags
- Reusable bags can be stored on inserts, making the device and bags immediately ready for refill when required.
- Flexible use, supporting a multitude of sorting and filling applications
- Multiple devices can be used concurrently along with the methodology to address larger or more complex sorting activities, including multidimensional sorting applications.
- The device and methodology are complementary and adaptable for use with bag storage and dispensing systems, such as Holmberg (3) and Ganti (4).

DESCRIPTION OF DRAWINGS—FIGS. 1-9

Embodiments of the invention are described hereinafter with reference to the accompanying drawings. In the drawings, closely related figures have the same number but different alphabetic suffixes. A list a reference numerals and a cross reference to applicable figures is provided following the description of drawings.

Figure 3A:
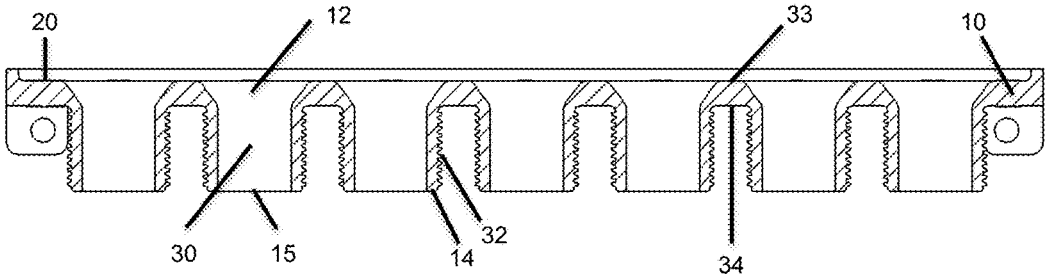
Figure 3B:
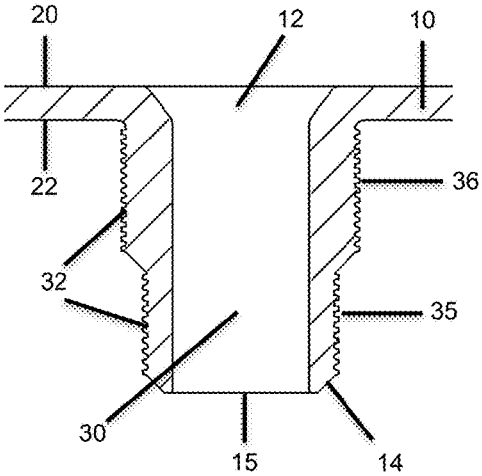
Figure 3C:
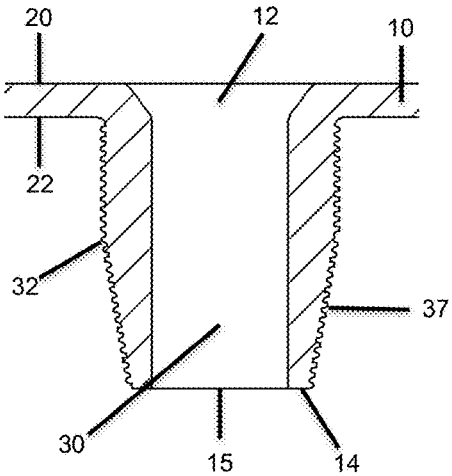
Figure 3D:
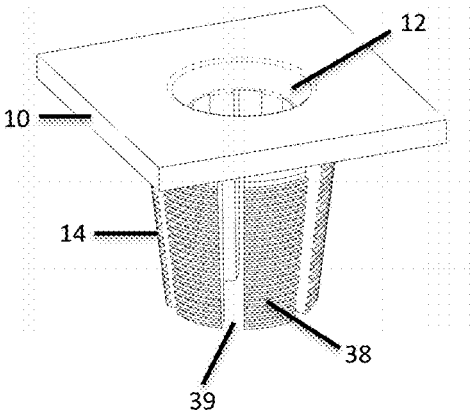

FIG. 3A-3D are views of various ribbed insert shapes. FIG. 3A shows a cross section of one row of the ribbed tubular inserts as integrated into the horizontal plate in the first embodiment. FIGS. 3B, 3C, and 3D illustrate alternative embodiments of the ribbed tubular inserts supporting various sized bags.

Figure 4A:
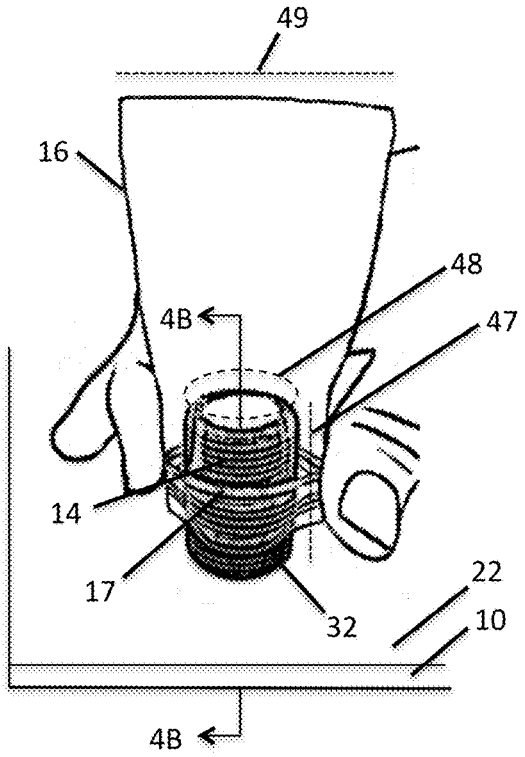
Figure 4B:
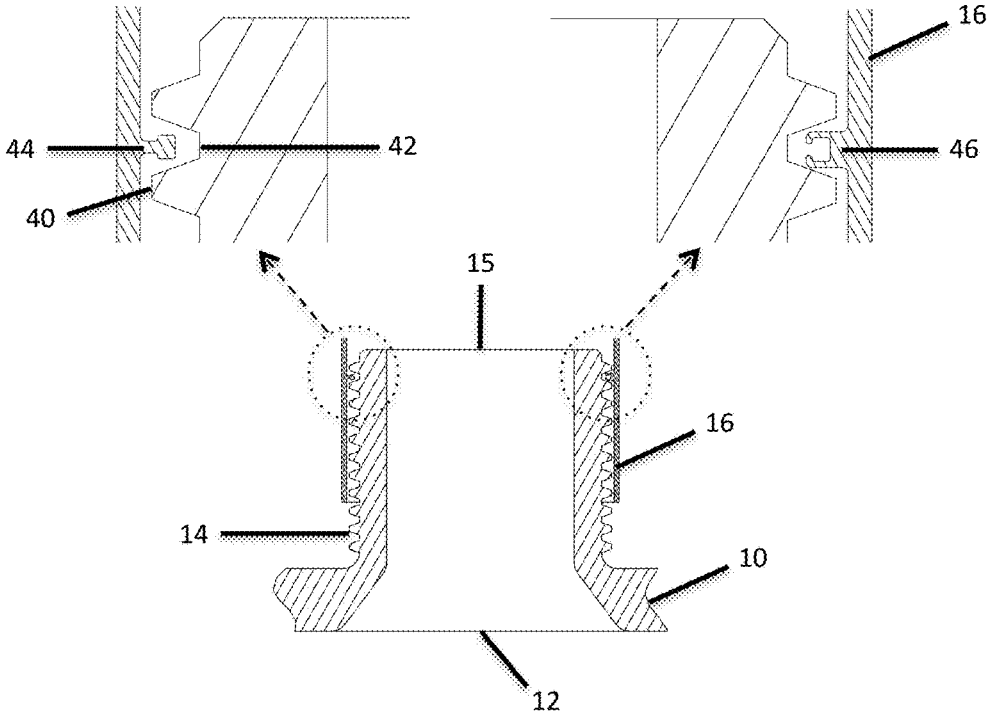

FIG. 4A-4B illustrate the placement of a bag over the ribbed tubular insert, and the engagement of the tongue and groove of the bag strip fastener with the ridges and grooves of the ribbed tubular insert.

Figure 5A:
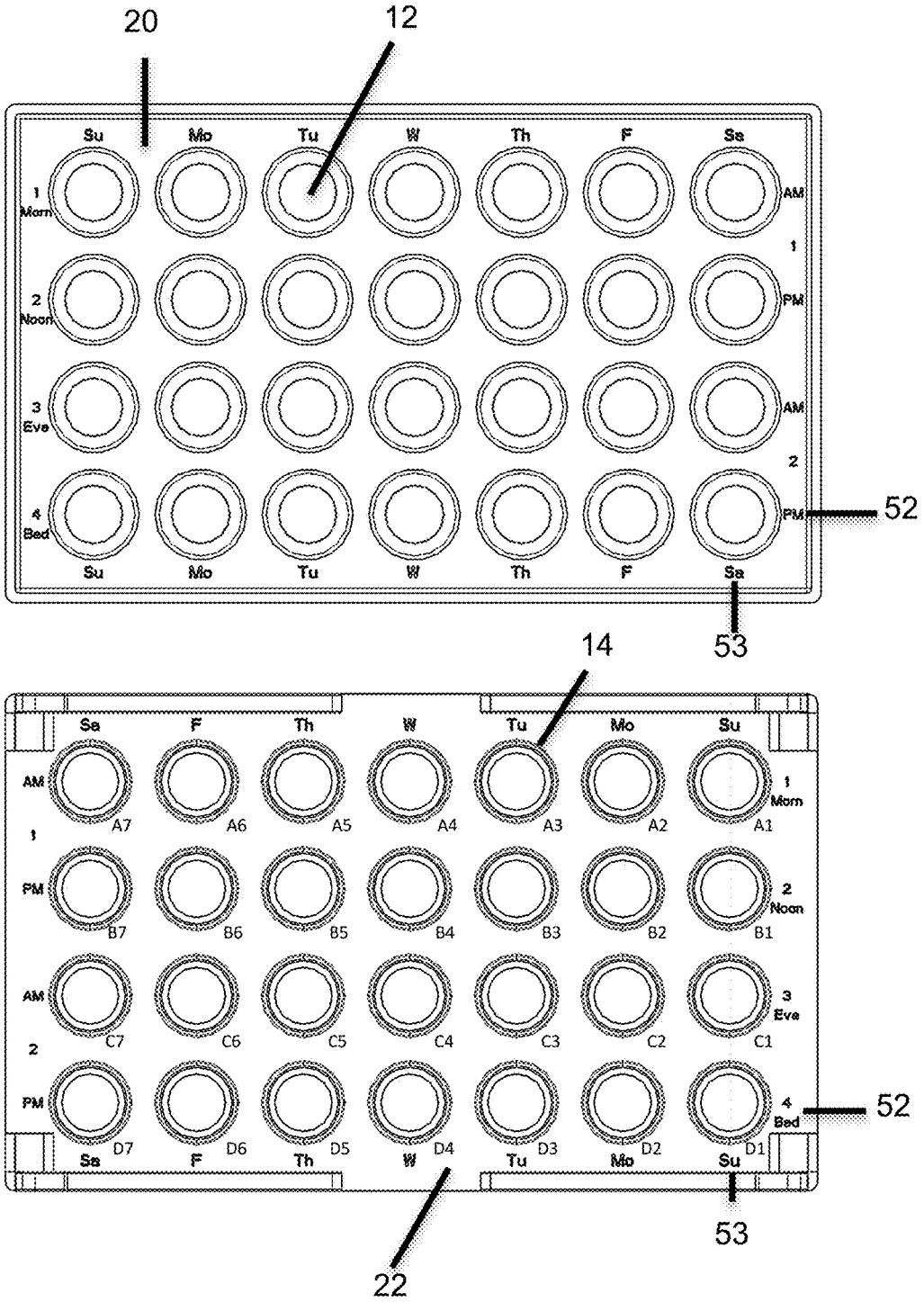
Figure 5B:
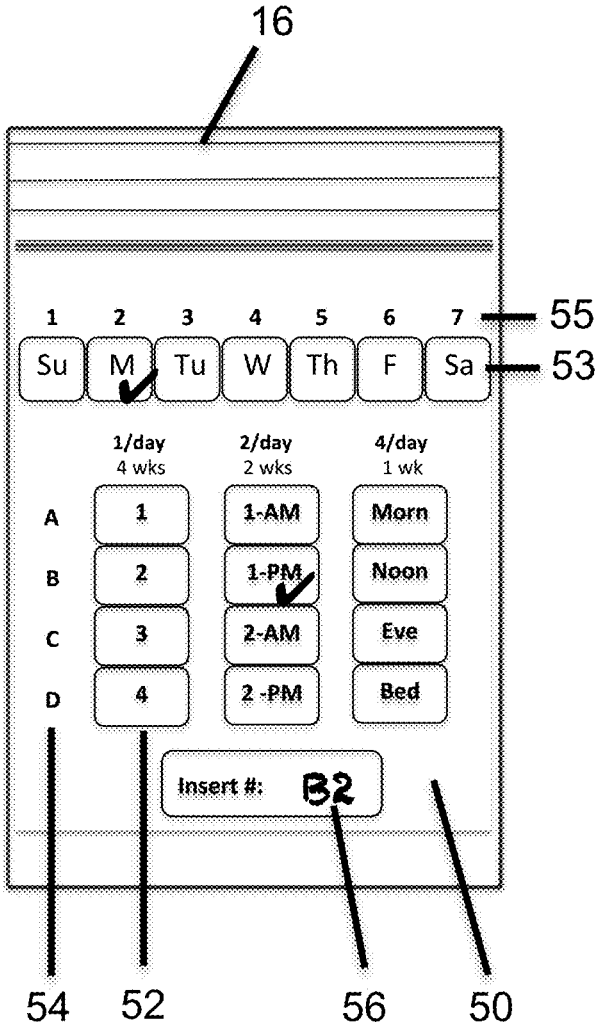

FIG. 5A-5B illustrate the labeling scheme of the device and the associated bags for the first embodiment. FIG. 5A shows the top and underside views of the plate illustrating a four by seven (4×7) grid of inserts with imprinted labeling, which support the sorting of medicaments by various combinations of week, day, and time. FIG. 5B shows a bag with an imprinted label that can be marked for association with the device inserts and content identification for subsequent dispensing.

Figure 6A:
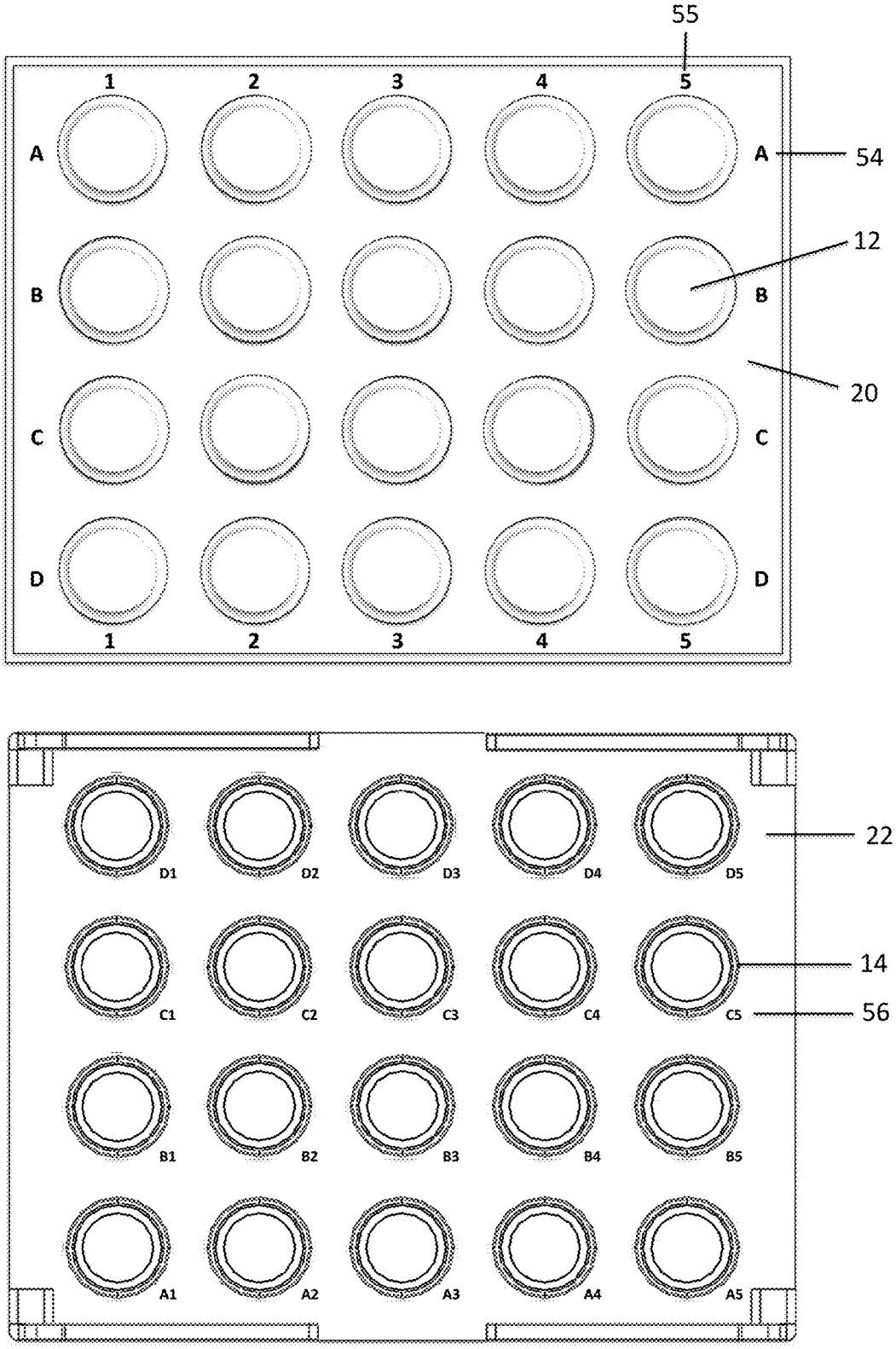
Figure 6B:
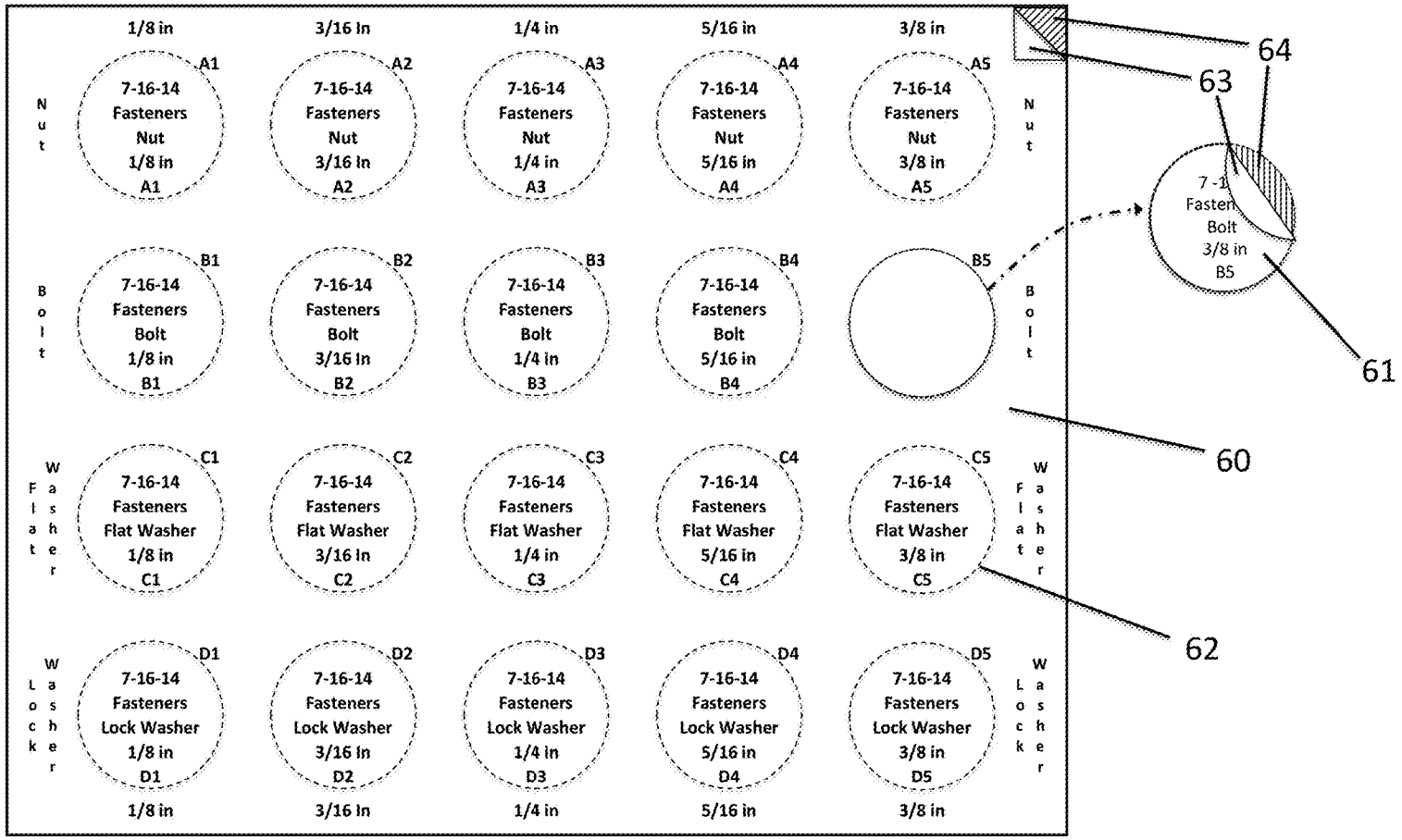
Figure 6C:
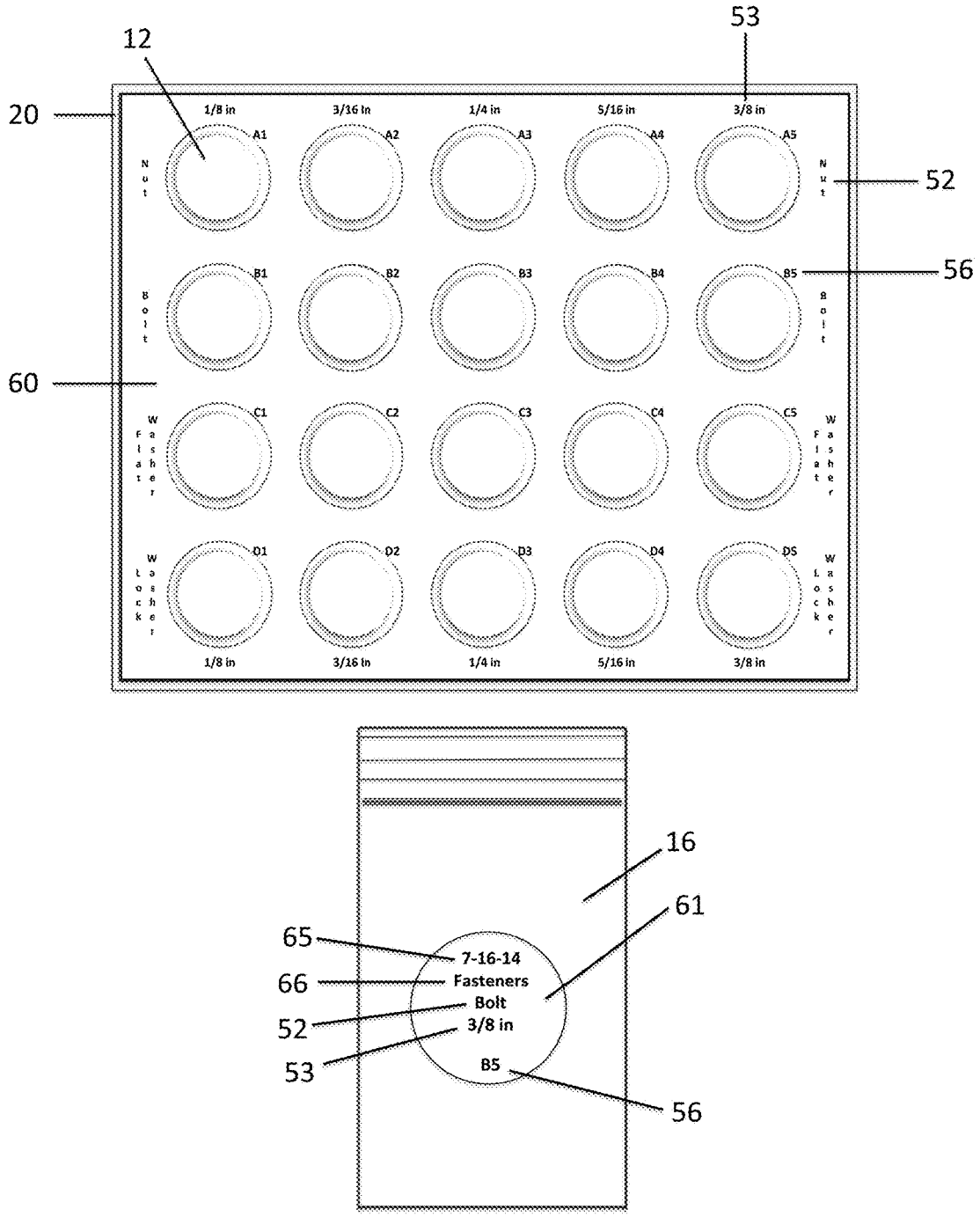

FIG. 6A-6C illustrates an additional embodiment for a General-purpose Sorting and Filling Device and companion Labeling Sheet. FIG. 6A shows the top and underside views of the General-purpose Sorting and Filling Device, illustrating a four by five (4×5) grid of Material Feed Openings and Ribbed Tubular Inserts. FIG. 6B shows a printable Labeling Sheet comprised of a Sort Criteria Overlay and removable Bag Content Labels. FIG. 6C illustrates one of the Bag Content Labels applied to a plastic bag, and the remaining Sort Criteria Overlay applied to the topside of the General-purpose Sorting and Filling Device.

Figure 7:
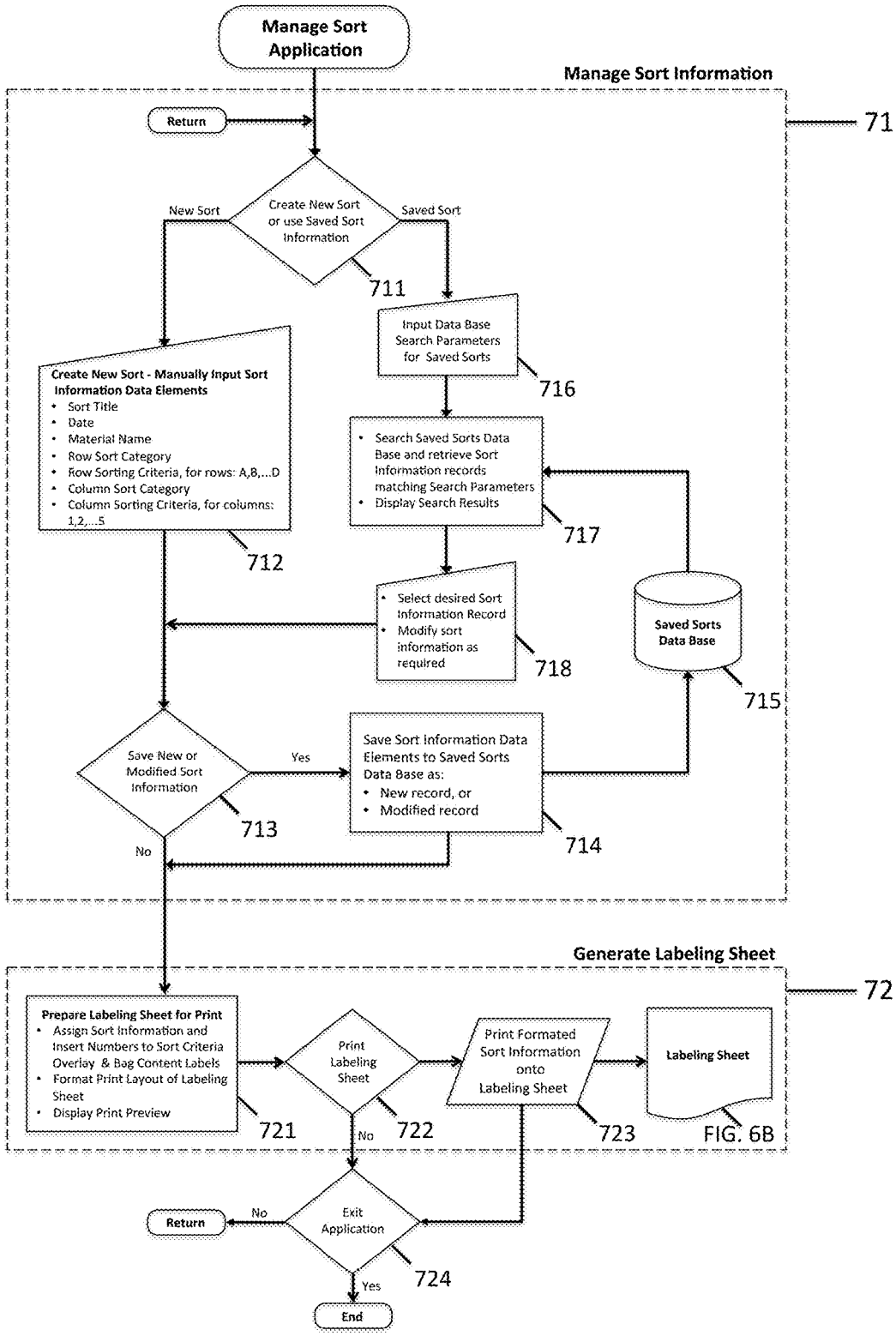

FIG. 7 is a flow chart specifying the computer system functionality of the Manage Sort Application processes: Manage Sort Information and Generate Labeling Sheet, for use with the General-Purpose Sorting and Filling Device (FIG. 6A) and Labeling Sheet (FIG. 6B).

Figures 6B, 7, 8:
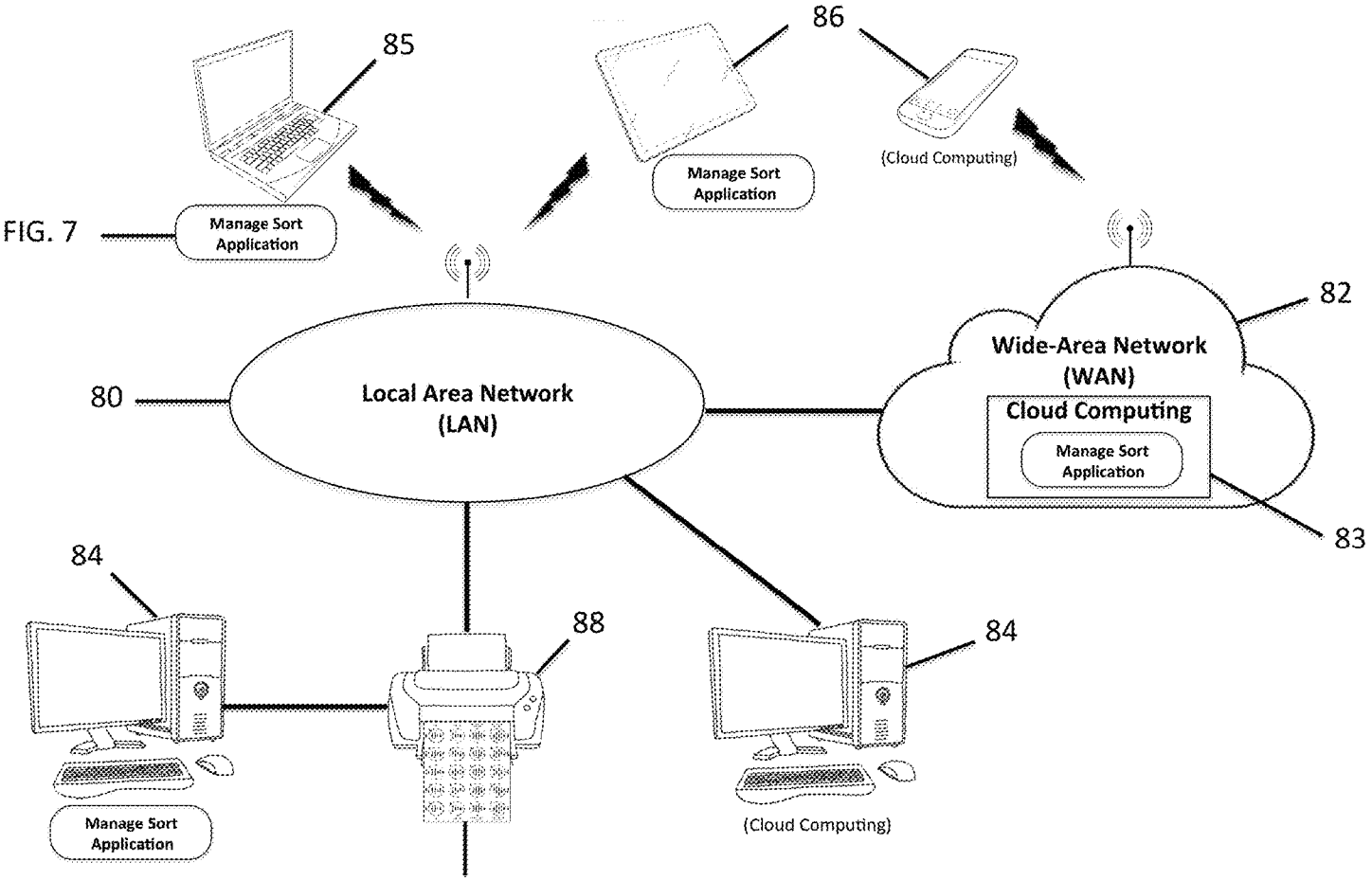

FIG. 8 is a system diagram showing a plurality of interconnected computing environments within which the Manage Sort Application operates.

Figure 9A:
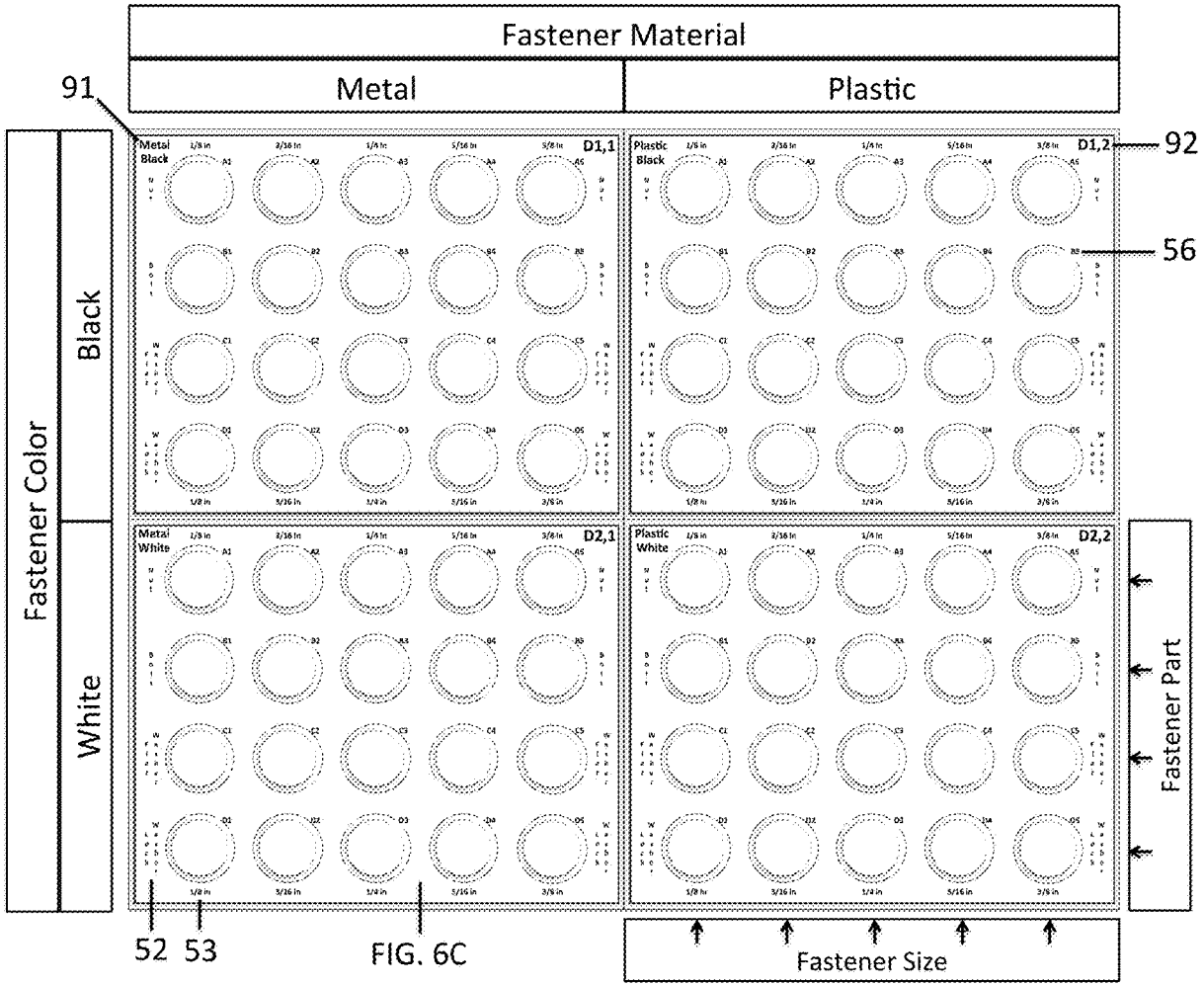
Figure 9B:
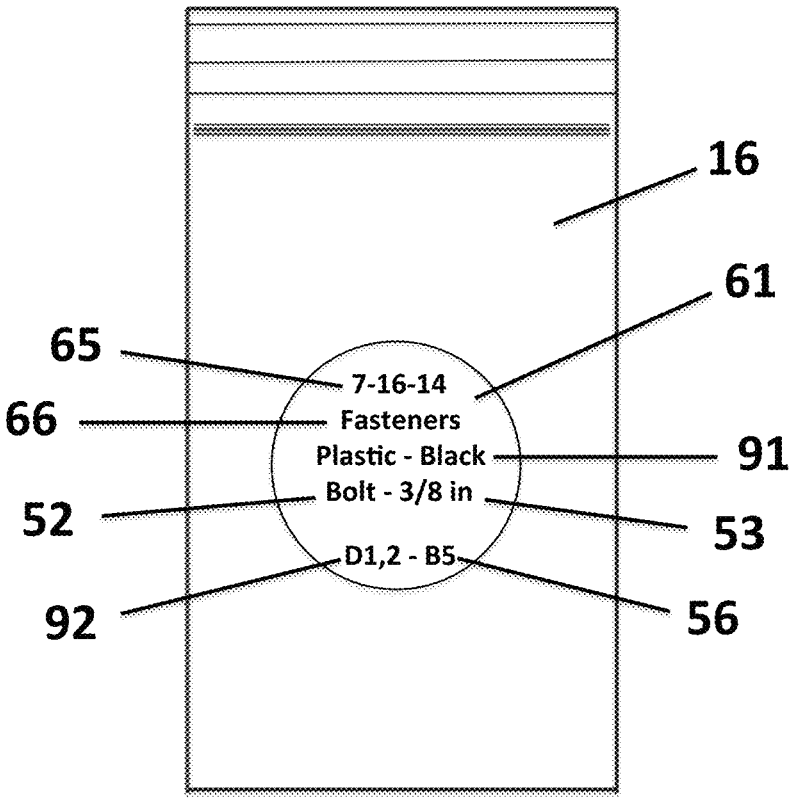

FIG. 9A-9B shows an additional embodiment that further includes a plurality of General-Purpose Sorting and Filling Devices arranged together to increase the number of available inserts and enable multidimensional sorting activities.

Drawings - List of Reference Numerals

| Reference Numeral | Description | Applicable FIGS. |
|---|---|---|
| 10 | Plate | 1, 2, 3A, 3B, 3C, 4A, 4B |
| 12 | Material Feed Opening | 1, 3A, 3B, 3C, 4B, 5A, 6A, 6C |
| 14 | Ribbed Tubular Insert | 1, 2, 3A, 3B, 3C, 4A, 4B, 6A |
| 15 | Material Discharge Location | 1, 2, 3A, 3B, 3C, 4B |
| 16 | Re-sealable Plastic Bag | 1, 4A, 4B, 5B, 6C, 9B |
| 17 | Interlocking Strip Fastener | 1, 4A |
| 18 | Support member | 1, 2 |
| 19 | Horizontal Work Surface | 1, 2 |
| 20 | Top Side of Plate | 2, 3A, 3B, 3C, 5A, 6A, 6C |
| 22 | Underside of Plate | 2, 3B, 3C, 4A, 5A, 6A |
| 24 | Support Member in Stowed Position | 2, 5A, 6A |
| 26 | Support Member Attachment Pivot Point | 2 |
| 30 | Material Pass-through Conduit | 3A, 3B, 3C |

-continued

| Drawings - List of Reference Numerals | | |
|---|---|---|
| Reference Numeral | Description | Applicable FIGS. |
| 32 | Insert Ribs | 3A, 3B, 3C, 4A |
| 33 | Material Feed Opening Spacing | 3A |
| 34 | Ribbed Tubular Insert Spacing | 3A |
| 35 | Smallest Fixed Diameter Insert | 3B |
| 36 | Largest Fixed Diameter Insert | 3B |
| 37 | Variable Diameter Insert | 3C |
| 38 | Ribbed Tab | 3D |
| 39 | Tab Gap | 3D |
| 40 | Insert Rib - Ridge | 4B |
| 42 | Insert Rib - Groove | 4B |
| 44 | Strip Fastener Tongue | 4B |
| 46 | Strip Fastener Groove | 4B |
| 47 | Insert Vertical Projection | 4A |
| 48 | Insert Outside Circumference ($I_C$) | 4A |
| 49 | Bag Width ($B_W$) | 4A |
| 50 | Imprinted Bag Label | 5B |
| 52 | Row Sorting Criteria | 5A, 5B, 6C, 9A |
| 53 | Column Sorting Criteria | 5A, 5B, 6C, 9A |
| 54 | Device Row Indicator | 5B, 6A |
| 55 | Device Column Indicator | 5B, 6A |
| 56 | Insert Number ($I_{rc}$) | 5B, 6A, 6C, 9A, 9B |
| 60 | Sort Criteria Overlay | 6B, 6C |
| 61 | Bag Content Labels | 6B, 6C, 9B |
| 62 | Perforated Label Edge | 6B |
| 63 | Adhesive Side | 6B |
| 64 | Peel Away Backing | 6B |
| 65 | Sort Date | 6C, 9B |
| 66 | Sort Material | 6C, 9B |
| 71 | Manage Sort Information Process | 7 |
| 72 | Generate Labeling Sheet Process | 7 |
| 80 | Local Area Network (LAN) | 8 |
| 82 | Wide Area Network (WAN) | 8 |
| 83 | Cloud Computing | 8 |
| 84 | Computer Workstations | 8 |
| 85 | Portable Computers | 8 |
| 86 | Mobile Smart Devices | 8 |
| 88 | Standard Printer | 8 |
| 91 | Device Sort Criteria | 9A, 9B |
| 92 | Device Number ($D_{RC}$) | 9A, 9B |

DETAILED DESCRIPTION

First Embodiment—FIGS. 1, 2, 3A, 4, 5

Figure 1:
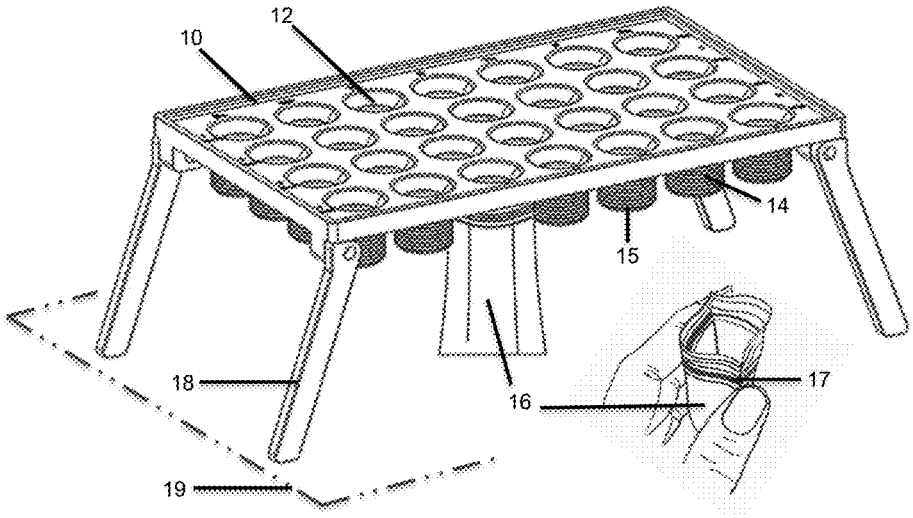
FIG. 1 is a perspective view of a first embodiment of a bag sorting and filling device as applied to medicaments. This view illustrates the topside of a rectangular plate incorporating a labeled grid of tapered material feed openings leading to ribbed tubular inserts, upon which plastic bags are attached.
Figure 2:
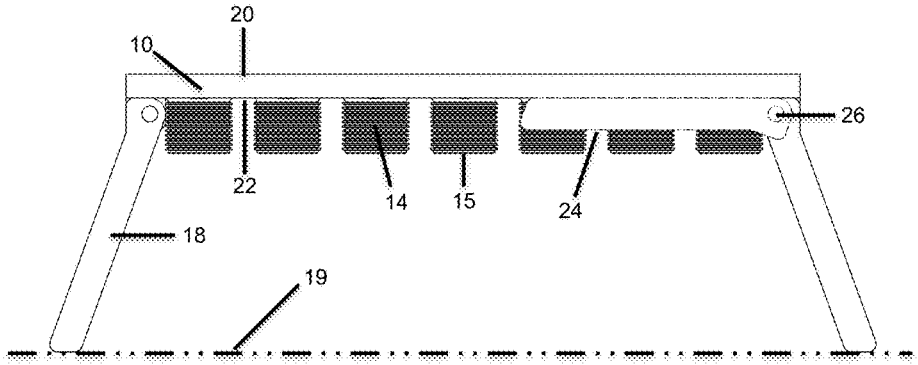
FIG. 2 is a side view of the first embodiment, which shows the ribbed inserts vertical projection below the horizontal plate. The plate is shown supported by adjustable support members that are used to set the height of the plate above the working surface, and are collapsible to support the stowage of the device when not in use.

FIG. 1 is a perspective view and FIG. 2 provides a side view of a sorting and filling device, of the first embodiment, for use with up to twenty-eight re-sealable plastic bags 16 that incorporate interlocking strip fasteners 17. The bags used with the first embodiment are of fixed size, and are envisioned to be two inches in width and three inches in length, but the device can be built to support multiple bag sizes. The sorting and filling device is comprised of a rectangular shaped plate 10, having a top side 20 and underside 22, and up to twenty eight ribbed tubular inserts 14, each of a fixed diameter, vertically integrated into the underside 22 of the plate. The rectangular plate and integrated ribbed tubular inserts are elevated above a working surface 19 by four adjustable support members 18, which can be pivoted about their attachment point 26, to vary the plate height, and fold to a stowed position 24. Each ribbed tubular insert 14 is accessed through an associated material feed opening 12 located on the top side of the plate 20, with said opening passing through the plate and continuing through the associated ribbed tubular insert 14 to a material discharge location 15. The material feed openings 12 and associated ribbed tubular inserts 14 are arranged on the top and bottom sides of the plate in a planar array consisting of a two-dimensional grid pattern arranged by rows and columns.

FIG. 3A is a cross-sectional view of one row of the ribbed tubular inserts 14 as integrated into the plate 10. Coaxial alignment of the tapered material feed opening 12 is shown in conjunction with the ribbed tubular insert 14. This alignment creates a material pass-through conduit 30 from the top of the plate 20 material feed opening 12, through the ribbed tubular insert 14, to the material discharge location 15. The material feed opening spacing 33 uniformly separates adjacent material feed openings 12 from one another, and likewise, the ribbed tubular insert spacing 34 uniformly separates the adjacent ribbed tubular inserts 14 in both the rows and columns.

FIGS. 4A-4B illustrate the bag interlocking strip fastener 17 engagement with the ribbed tubular insert 14. In FIG. 4A, a bag of fixed width 49 is shown slipped over the ribbed tubular insert 14 of fixed diameter. FIG. 4B is a magnified cross section view of the strip fastener 17 tongue 44 and grove 46 detail shown in relationship to the tubular insert rib 32 ridges 40 and groves 42 when engaged. The ribbed tubular insert vertical projection 47 from the bottom of the plate 10 is determined to be of sufficient length to allow the secure engagement of the bag's interlocking strip fastener 17 with the ribbed tubular insert 14, when the opened mouth of the bag is placed over the insert. The Insert Outside Circumference ($I_C$) 48 and the dimensioning of the corresponding ridges 40 and grooves 42 making up the insert ribs 32 are determined as a function of the bag width ($B_W$) 49. The insert dimensions are selected in order to satisfy two functional objectives:

1) The Insert Rib Ridges 40 and Grooves 42 securely engage the Strip Fastener Tongue 44 and Groove 46 to support the weight of the attached bag and its material contents, while the bag is freely suspended vertically above the Horizontal Work Surface 19, and
2) The user can manually slide the bag on and off the Ribbed Tubular Insert 14 easily, and without undue force.

These objectives are subject to the physical geometry of the bag and insert, which constrains the Insert Outside Circumference ($I_C$) 48 and the Bag Width ($B_W$) 49 by: $I_C<2\ B_W$. That is, the Insert Outside Circumference ($I_C$) 48 is constrained to be less than two times the Bag Width ($B_W$). The Insert Outside Circumference ($I_C$) 48 which satisfies the above two functional objectives and physical constraint can be determined by someone skilled in the art using empirical and/or analysis methods. The desired insert sizing is chosen by trading off the amount of weight that can be supported (Greater weight support=>Larger insert circumference), against the ease of securing and removing the bag from the insert (Greater handling ease=>Smaller insert circumference). The required dimensioning of the insert ridges 40 and grooves 42, can be determined by closely matching their size and spacing to the tongue 44 and groove 46 dimensions of the strip fasteners for the selected bag size.

Association of each bag's material contents with the applicable sorting criteria is accomplished using a labeling system that uniquely associates each bag 16 with the material feed opening 12 and its associated ribbed tubular insert 14. FIG. 5A shows the material feed openings 12 and associated ribbed tubular inserts 14 arranged on the top side 20 and underside 22 of the plate, in a two dimensional grid pattern consisting of rows and columns. In the first embodiment, the grid labeling is accomplished as follows: The Column Sorting Criteria 53 are labeled to identify the seven days of the week (Sunday thru Saturday). The Row Sorting Criteria 52 are labeled to support multiple sorting options, including: weeks 1 through 4; AM and PM for weeks 1 and 2; and four times per day (morn through bed) for one week. FIG. 5B illustrates a Bag 16 incorporating an Imprinted Bag Label 50 with a labeling scheme that matches the grid labeling of the device. The Imprinted Bag Label 50 is marked to specify the desired sorting criteria, and then uniquely associated with the Insert Number 56 corresponding to the marked sorting criteria. The Insert Number 56 is determined by combining the Device Row Indicator 54 with the Device Column Indicator 55 associated with the marked sorting criteria. In FIG. 5B, the Imprinted Bag Label 50 is marked to indicate Monday—PM of the first week, which is associated with Insert Number 56, B2—(Row B & Column 2).

Additionally, each row of the material feed openings 12 and associated ribbed tubular inserts 14 can be color coded, using four distinct colors, to provide a visual differentiation aid during the filling process. Likewise, each bag label 52 can also be color coded to match the colors on the device, to further aid the user in associating the proper bag 16 and insert 14.

Operation—FIGS. 1, 3, 4, 5

In the first embodiment, Bags 16 are made ready for filling by marking each Imprinted Bag Label 50 with the desired contents as determined by the sorting criteria. The day of the week (Column Sorting Criteria 53) and time of day (Row Sorting Criteria 54) is marked. The corresponding unique Insert Number 56, is then written on the Imprinted Bag Label 50. The process is continued, until all required bags 16 have been labeled. The device is made ready for the sorting and filling process by placing the top of the plate 20 face down onto the work surface 19, which orients the inserts 14 in a vertical direction pointing away from the work surface 19. The user then attaches individual bags 16 to the appropriate insert 14 as follows: The user matches the Insert Number 56 written on the Imprinted Bag Label 50, with the Insert Number 56 imprinted on the Underside of the Plate 22. The user opens the mouth of one bag by pressing the two ends of the bag opening towards one another. With the mouth of the bag held open, the user then slips the bag over the identified insert 14 until the top of the bag makes contact with the underside of the plate 22, and the interlocking strip fastener 17 tongue 44 and groove 46 is securely engaged with the ridges 40 and grooves 42 of the ribbed tubular insert 14. This process is repeated until all required bags 16 have been attached to their correspondingly numbered ribbed tubular inserts 14. The user then inverts the device, with the bags now vertically suspended, and the top of the plate 20 facing up. The user rotates the support members 18 to adjust the vertical height of the plate to ensure the bottom of the bags clear the work surface 19, and that each bag suspends freely, held only by the ribbed tubular insert 14. The user proceeds to sort the material and then place it into the appropriate labeled bag by depositing the material into the correspondingly labeled material feed opening 52. As the user releases the material, it passes through the material feed opening 12, and then proceeds through the material pass-through conduit 30, exiting the insert at the material discharge location 15, and then entering the attached bag 16, and finally coming to rest at the bottom of the attached bag. The material sorting and filling process continues until all material has been dispensed into the appropriate bags. When the filling process is complete, the user then removes each bag 16 from the device by grabbing each bag and pulling it in a downward direction, until the bag slips off its insert 14 and the top of the bag clears the bottom of the insert, below the material discharge location 15. The contents of each bag are then secured by sealing the bag using its interlocking strip fastener 17.

Additional Embodiments—FIGS. 6, 7, 8, 9

FIG. 6 illustrates a General-purpose Sorting and Filling Device used in conjunction with a printable Labeling Sheet. FIG. 6A shows the General-purpose Sorting and Filling Device Top Side 20 and Underside 22 of a Plate containing a 4-row by 5-column arrangement of Material Feed Openings 12 and associated Ribbed Tubular Inserts 14. The Top Side of the Plate 20 is imprinted with the Device Row Indicators 54 (A-D) and the Device Column Indicators 55 (1-5). The Underside of the Plate 22 is imprinted with the device Insert Numbers 56 corresponding to the row and column indicators. FIG. 6B illustrates a printable Labeling Sheet comprised of a Sort Criteria Overlay 60 and removable Bag Content Labels 61. The printable Labeling Sheet includes an Adhesive Side 63 that is protected with a Peel Away Backing 64. The Bag Content Labels 61 have a Perforated Label Edge 62 that allows the Bag Content Labels 61 and associated Peel Away Backing 64 to be removed from the sheet. The printable sheet is compatible with standard business or personal printers including, but not limited to, laser and inkjet printers. FIG. 6C illustrates the Sort Criteria Overlay 60 applied to the Top Side of the Plate 20 and a Bag Content Label 61 applied to a Re-sealable Plastic Bag 16. The Sort Criteria Overlay 60 contains the printed Row Sorting Criteria 52 and Column Sorting Criteria 53. The Bag Content Labels 61 are imprinted with sort information pertaining to the bag contents, including, but not limited to, the Sort Date 65, Sort Material 66, and applicable Row Sorting Criteria 52, and Column Sorting Criteria 53. The Bag Content Labels 61 are also imprinted with the corresponding Insert Number 56, which is determined from the Device Row Indicator 54 and Device Column Indicators 55. The Bag Content Labels 61 are separated from the printable Labeling Sheet (FIG. 6B), by manually applying pressure to the Perforated Label Edge 62. The Bag Content Labels 61 are applied to the Re-sealable Plastic Bag 16 by removing the Peel Away Backing 64, and then applying the Adhesive Side 63 of the Bag Content Labels 61 to the Re-sealable Plastic Bag 16. Once all the Bag Content Labels 61 have been removed, the remaining portion of the Labeling Sheet becomes the Sort Criteria Overlay 60. The Sort Criteria Overlay 60 is placed onto the Top Side of the Plate 20, with the holes associated with the removed Bag Content Labels 61 aligned over the Material Feed Openings 12 (FIG. 6C).

It is anticipated that the General-purpose Sorting and Filling Device will be utilized for numerous and distinct sorting activities, many of which may be repeated from time-to-time. Management of the information associated with a user's individual or plurality of sorting activities is accomplished through a computer system application that works in conjunction with the General-purpose Sorting and Filling Device (FIG. 6A), and the printable Labeling Sheet (FIG. 6B). FIG. 7 is a flow chart specifying the computer system functionality of the Manage Sort Application, comprised of two processes: Manage Sort Information Process 71 and Generate Labeling Sheet Process 72. The Manage Sort Information Process 71 provides the capability for entering, modifying, saving, and retrieving sort information associated with specific sorting activities. The Generate Labeling Sheet Process 72 provides the capability to format and print a Labeling Sheet (FIG. 6B) with the applicable sort information obtained from the Manage Sort Information Process 71.

The Manage Sort Information Process 71 begins in step 711, in which the user is queried to determine whether to utilize previously saved sort information or create a new sort. If the user indicates that a new sort is to be created, the user is then prompted to enter the sort information data elements in step 712. The sort information data elements include, but are not limited to: Sort Title, Sort Date 65, Sort Material 66, Row Sorting Criteria 52 for rows (r)=A, B, . . . D, and Column Sort Criteria 53 for columns (c)=1, 2, . . . 5. Once the new sort information data elements have been entered, the user is then queried in step 713 as to whether the new sort information is to be saved. If the user responds affirmatively, step 714 saves the entered sort information data elements as a new Saved Sort record to the Saved Sorts Data Base 715. The Manage Sort Information Process 71 is then exited and proceeds to the Generate Labeling Sheet Process 72. If the user chooses to not save the new sort information in step 713, the process is then exited and proceeds directly to the Generate Labeling Sheet Process 72.

If the user indicates in step 711 that a previously Saved Sort is to be utilized, the user is prompted in step 716 to enter the desired data base search parameters to retrieve the Saved Sort record of interest. The search parameters can include the Sort Title or any combination of the Saved Sort record data elements. The Saved Sorts Data Base 715 is then searched in step 717, using the entered search parameters, and the Saved Sort records matching those parameters are retrieved and then presented to the user. In step 718 the user selects the desired Saved Sorts record from those displayed and is given the option of modifying the retrieved Saved Sort record data elements. If the user modifies the retrieved Saved Sort record, step 713 then gives the user the option of saving the changes to the existing Saved Sort record, or creating a new Saved Sort record based on those changes. If the user opts to save the changes, they are saved to the Saved Sorts Data Base 715, in step 714. The Manage Sort Information Process 71 is then exited and proceeds to the Generate Labeling Sheet Process 72.

The Generate Labeling Sheet Process 72 begins in step 721, where the currently selected sort information in the Manage Sort Information Process 71, is mapped to the Sort Criteria Overlay 60 and Bag Content Labels 61 comprising the Labeling Sheet (FIG. 6B). The Row Sorting Criteria 52 and Column Sorting Criteria 53 are positioned on the Sort Criteria Overlay 60 such that, when the Sort Criteria Overlay 60 is placed over the Top Side of Plate 20 (FIGS. 6A & 6C), the Row Sorting Criteria 52 and Column Sorting Criteria 53 are aligned directly over the corresponding Device Row Indicator 54 and Device Column Indicator 55 respectively. That is:

Row Sorting Criteria 52 for row "r" is aligned over Device Row Indicator 54: "r", and Column Sorting Criteria 53 for column "c" is aligned over Device Column Indicator 55: "c"

Where: r=A, B, C, D and c=1, 2, 3, 4, 5

Each Bag Content Label 61 contains the following sort information:

Sort Date 65

Sort Material 66

Row Sorting Criteria 52 for row (r)

Column Sorting Criteria 53 for column (c)

Insert Number 56

Where: r=A, B, C, D and c=1, 2, 3, 4, 5

The Insert Number $I_{rc}$ 56 for each Bag Content Label 61 is determined according to the combination of the Device Row Indicator 54 and Device Column Indicator 55, corresponding to the applicable Row Sorting Criteria 52 and Column Sorting Criteria 53. That is: Insert Number $I_{rc}$=r & c, for the applicable value of r and c. For example, in FIG. 6B the removed Bag Content Label 61 corresponds to the Device Row Indicator 54="B", and Device Column Indicator 55="5", making the Insert Number $I_{rc}$ 56="B5". This process is repeated until the content for each bag label has been determined for all combinations of r and c. It will be apparent to one skilled in the art that the number of rows and columns is dependent on the sizing and configuration of the General-purpose Sorting and Filling Device, and that the Manage Sort Application can be generalized to handle any number of inserts and any corresponding configuration of rows and columns.

Once the Sort Criteria Overlay 60 and Bag Content Label 61 printable field contents have been determined, the print layout is then formatted in step 721 to align with the corresponding physical dimensions of the Labeling Sheet (FIG. 6B). A print preview of the formatted Labeling Sheet is then presented to the user.

Upon the user's affirmative command in step 722, the formatted Labeling Sheet is printed in step 723. Once the Labeling Sheet has been printed, the user is then given the option in step 724 of exiting the application, or returning to the Manage Sort Information Process 71. If the user chooses to not to print the Labeling Sheet, the option of exiting the application, or returning to the Manage Sort Information Process 71 to modify the current sort information record, or start a new record, is presented in step 724.

FIG. 8 illustrates the typical standalone and interconnected operational environments for the Manage Sort Application. The interconnected environment includes Local Area Networks (LAN) 80 and a Wide Area Network (WAN) 82, within which, various computational platforms (processing systems) such as Computer Workstations 84, Portable Computers 85, and Mobile Smart Devices 86 operate. The computational platforms act as the user control and display interface to the application, and include but are not limited to, personal computers, laptops, netbooks, smart phones, and tablets. The application resides and executes directly on any of these computational platforms or in the Wide-Area Network (WAN) 82 environment on a cloud-computing platform. The computational devices connect directly to a Standard Printer 88, or remotely through the WAN/LAN 80,82, for the production of the Labeling Sheet (FIG. 6B).

FIGS. 9A-B illustrate an additional embodiment, which supports sorting activities that encompass large or more complex sorting criteria. In this embodiment a plurality of General-purpose Sorting and Filling Devices are used concurrently to increase the number of available inserts and enable the execution of multidimensional sorting activities. FIG. 9A illustrates a multi-dimensional sorting activity in which four General-purpose Sorting and Filling Devices (FIG. 6A) are arranged together in a (2×2) configuration. Each device utilizes the Sort Criteria Overlay 60 shown in FIG. 6C, where, in that example, the sort objective was to organize Fasteners by Part (Row Sorting Criteria 52) and Size (Column Sorting Criteria 53). In this sort example, the sorting objective is expanded to further include sorting the Fasteners by Material and Color. Thus the Fasteners now have sort categories that include all combinations of: Material/Color/Part/Size. The four additional sort criteria combinations resulting from the new sort categories of Material and Color (Metal-Black, Metal-White, Plastic-Black, Plastic-White), are allocated to each of the four devices, as Device Sort Criteria 91. The Device Sort Criteria 91 are added to the printed Sort Criteria Overlay 60 (FIG. 9A) and the printed Bag Content Label 61 (FIG. 9B). Each Device is assigned a unique Device Number ($D_{RC}$) 92 corresponding to its row (R) and column (C) position in the organization of the devices, where R=1, 2, 3 . . . j and C=1, 2, 3 . . . k. The Device Number 92 ($D_{RC}$) is added to the printed Sort Criteria Overlay 60, and annotated as ("D"&R,C). For example, in FIG. 9A the device positioned in the first row (R=1) and second column (C=2) is annotated as "D1,2". The Device Number ($D_{RC}$) 92 is combined with the associated device Insert Number ($I_{rc}$) 56 and annotated as ($D_{RC}$"-"$I_{rc}$) to provide a unique device and insert identifier printed on each of the Bag Content Labels 61.

It will be clear to one skilled in the art that this additional embodiment can be expanded to include a General Purpose Sorting Solution comprising:

(1) A General-purpose Sorting and Filling Device containing a fixed (m×n) number of inserts configured as (m) rows and (n) columns;

(2) A Labeling Sheet (FIG. 6B) appropriately sized for the given (m×n) device.

(3) Any (j×k) number of General-purpose Sorting and Filling Devices arranged in j rows and k columns.

The General Purpose Sorting Solution can be configured to address sorting activities of dimension one, two, three, four and beyond. These multidimensional sorting activities are managed by extending the functionality of the Manage Sort Application (FIG. 7), including the Manage Sort Information Process 71 and the Generate Labeling Sheet Process 72, for use with multiple devices to accommodate additional sorting criteria.

The benefit of utilizing multiple devices concurrently includes expanding the number of available inserts and allowing for larger quantities of bags to be filled at the same time. Combining devices in this structured way also affords a convenient method for addressing more complex (e.g., 3+ dimensional criteria) sorting tasks, by labeling each device, or group of devices, with the appropriate sub-partitions.

Alternative Embodiments—FIGS. 3B-3D

There are various possibilities with regard to the size and shape of the ribbed tubular inserts. The embodiments presented above envision a fixed diameter cylindrically shaped insert, which is selected in order to engage bags of a fixed width. This approach allows for a relative small plate size and footprint supporting a large number of inserts, for the selected bag width. FIGS. 3B, 3C and 3D show three alternatives for variably shaped ribbed inserts that offer the flexibility to accommodate bags of different widths.

FIG. 3B shows a cross section of a ribbed insert 14 incorporating two fixed-diameter ribbed cylinders integrated along its elongated axis. Extensible to multiple cylinders of different diameters, this configuration accommodates two or more different bag widths, each corresponding to the applicable fixed diameter of the insert. The cylinders are arranged in ascending order of diameter, beginning with the smallest fixed diameter cylinder 35 nearest the material discharge location 15, and ending with the largest fixed diameter cylinder 36 located nearest the underside of the plate 22. Bags are slid onto the insert until the interlocking strip fastener 17 securely engages the ridges 40 and grooves 42 of the applicable cylinder.

FIG. 3C shows a cross section of a ribbed insert 14 having the shape of a frustum of a right circular cone, with a variable diameter insert 37 uniformly increasing, beginning at the material discharge location and ending at or before the underside of the plate 22. This configuration accommodates varying bag widths, with the range of bag widths corresponding to the variable rib diameter on the insert. A bag is slid onto the insert until the interlocking strip fastener reaches the appropriate diameter section of the insert, and securely engages its ridges and grooves.

FIG. 3D is a perspective view of a ribbed tubular insert 14 having the shape of frustum of a right circular cone similar to FIG. 3C, but comprised of six elongated ribbed tabs 38 of uniform size. The ribbed tabs 38 are distributed about the insert's elongated axis, and spaced equally apart by six tab gaps 39. This multi-tab design is applicable to various insert shapes and affords manufacturing and weight benefits. This embodiment of the cone-shaped insert also accommodates varying bag widths, with the range of bag widths corresponding to the variable rib diameter on the insert. A bag is slid onto the insert until the interlocking strip fastener reaches the appropriate diameter section of the insert tabs, and securely engages its ridges and grooves.

Other ribbed insert shapes can be anticipated including, but not limited to, elliptic cylinders, cones, and paraboloids, and shapes formed by polyhedra, having any number of sides.

CONCLUSION, RAMIFICATIONS, AND SCOPE

Accordingly, the reader will see that the sorting and filling device, of the various embodiments, provides an uncomplicated device and flexible method to organize and package a wide variety of lightweight materials with varied sorting criteria, utilizing common plastic storage bags that incorporate interlocking strip fasteners:

- The device offers a simple two-step method for the insertion (slide-on) and removal (slide-off) of the plastic bags
- The plate and inserts can be produced inexpensively as a single piece, using injection molding and other similar low cost manufacturing techniques.
- The plastic storage bags targeted for use with the device are applicable to a wide variety of applications, and are an accepted consumer and business staple in widespread use.
- The device is lightweight and projects a small footprint relative to the number and size of the bags it supports.
- The device is adaptable to bags of various sizes.
- The device grid arrangement lends itself to multiple sorting applications, and can be extended to support large numbers of bags and multi-dimensional sorting applications by combining devices.
- The complementary labeling scheme for the device grid and bags ensures the correlation of bag contents with the selected sorting criteria.

The embodiments described and shown are for purposes of illustration only, and are not to be construed as constituting any limitations of the invention. Modifications will be obvious to those skilled in the art, and all modifications that do not depart from the spirit of the invention are intended to be included in the invention. With respect to the preceding descriptions, it is to be understood that the desired dimensional relationships for the parts of the device, to include variations in size, materials, shape, form, and manner of operation, assembly and use, are deemed readily apparent to one skilled in the art, and all equivalent relationships to those illustrated in the drawings and described in the specification are intended to be encompassed in the invention.

What is claimed is:

1. A material sorting and filling device for use with a plurality of plastic bags, each incorporating an interlocking strip fastener, comprising:

a. a sheet of rigid material, with said sheet having top and under sides, b. a plurality of ribbed tubular inserts of predetermined size and shape, each containing an exterior wall surface comprised of a plurality of alternating ridges and grooves circumscribing the perimeter of said insert about its elongated axis, and each insert containing an internal smooth-wall hollow core, with a top opening for loading at a proximate end, and a bottom opening for discharging at a distal end, c. a plurality of support members, d. said tubular inserts arranged as a two-dimensional array and integrated into said sheet at predetermined locations, with each said insert elongated axis oriented perpendicular to the underside of said sheet, with the top end and associated opening of said insert resting flush with the top-side surface of said sheet, and passing through said sheet, and projecting through the underside a predetermined length, with distal end of said insert projecting away from the underside of said sheet, e. said support members joined to said sheet at spaced locations so as to be able to support said sheet horizontally at an adjustable height above a working surface, and without interfering with said insert projections, f. a predetermined set indicia uniquely identifying said inserts formed on said sheet, g. a set indicia applied to said sheet to associate a sorting criteria with said inserts, h. a set indicia applied to said bags to associate said sorting criteria and said inserts with said bags, whereby one can concurrently sort and fill materials into a plurality of plastic bags in an efficient manner.

2. The material sorting and filling device of claim 1 and the bags for use with said device, further including a flexible sheet, comprising:

a. an inscribable top side and an adhesive underside protected with a removable backing, b. a plurality of labels of predetermined size, each removable from said flexible sheet for application to said bags, c. a device overlay of predetermined size, removable from said flexible sheet for placement over the topside of said device, whereby one can utilize said labels to identify the contents of said bags and uniquely associate each said bag with its corresponding insert; and utilize said device overlay to associate said plurality of device inserts with the applicable said sorting criteria.

3. The material sorting and filling device of claim 1 and the flexible sheet of claim 2, further including a plurality of said devices and a corresponding plurality of said sheets, with said devices arranged together to form a labeled multi-dimensional array of said inserts and bags, whereby one can sort and fill materials encompassing increasingly complex sorting criteria.

4. At least one device of claim 1, the bags for use with said device, and at least one flexible sheet of claim 2, further including a computer system, comprising:

a. at least one processor, the processor being a hardware component of the computer system; and b. a memory system in communication with the processor, the memory system storing a plurality of instructions that when executed by the processor, execute the steps of:

c. providing an interface application, displayed on an electronic device, said interface having selectable options including at least an option to input sorting information, an option to save sorting information to a database, an option to access saved sorting information from the database, an option to modify saved sorting information, and an option to print sorting information onto said flexible sheet through a printing device;

d. in response to a user selection, via an electronic input device, of the option to input sorting information, accepting user entered sorting information;

e. in response to a user selection, via an electronic input device, of the option to save sorting information to a database, writes a sort information record to the database;

f. in response to a user selection, via an electronic input device, of the option to access saved sorting information from the database, accepting sort information search criteria, searching the database for records matching search criteria, and displaying matching sort information records;

g. in response to a user selection, via an electronic input device, of the option to modify saved sorting information, accepting user modifications to selected sort information record and saving changes to database;

h. in response to a user selection, via an electronic input device, of the option to print sorting information, assigning selected sort information to said device overlay and said bag labels, formatting and printing sorting information to said flexible sheet, whereby one can efficiently manage sorting application information and generate said device overlay and said bag labels.

5. The computer system of claim 4, wherein said selectable options further include managing multidimensional sorting information and generating a plurality of said device overlays and said bag labels supporting said multidimensional sorting information.

6. A method for sorting and filling materials with a plurality of differentiating criteria into a plurality of plastic bags incorporating interlocking strip fasteners, comprising:

a. providing at least one sorting and filling device comprising a plurality of ribbed tubular inserts, vertically integrated as a two-dimensional array in a horizontal plate, with each said insert containing an internal smooth-wall hollow core, with a top opening for loading at a proximate end, and a bottom opening for discharging at a distal end, with said plate and inserts elevated above a working surface by height-adjustable support members, b. labeling said array of inserts by the desired sorting criteria and similarly labeling each said bag to identify and correlate said bag contents to said inserts and sorting criteria, c. attaching said labeled bags to said labeled device inserts in a predetermined way, d. sorting and filling said plastic bags, by placing said material into the appropriate labeled insert according to said material sorting criteria, whereby one can utilize said methodology to fill materials into a plurality of plastic bags in an organized and efficient manner.

7. The method of claim 6, further including arranging a plurality of said devices to form a multi-dimensional array of said inserts and bags, whereby one can sort and fill materials encompassing increasingly complex sorting criteria.

8. The method of claim 6 further including, providing at least one flexible sheet, and a computer system, comprising:

a. providing an interface application, displayed on an electronic device, said interface having selectable options including at least an option to input sorting information, an option to save sorting information to a database, an option to access saved sorting information from the database, an option to modify saved sorting information, and an option to print sorting information onto said flexible sheet through a printing device;

b. in response to a user selection, via an electronic input device, of the option to input sorting information, accepting user entered sorting information;

c. in response to a user selection, via an electronic input device, of the option to save sorting information to a database, writes a sort information record to the database;

d. in response to a user selection, via an electronic input device, of the option to access saved sorting information from the database, accepting sort information search criteria, searching the saved sort information database for records matching search criteria, and displaying matching sort information records;

e. in response to a user selection, via an electronic input device, of the option to modify saved sorting information, accepting user modifications to selected sort information record and saving changes to saved sort information database;

f. in response to a user selection, via an electronic input device, of the option to print sorting information, assigning selected sort information to said device overlay and said bag labels, formatting and printing said flexible sheet;

whereby one can efficiently manage sorting application information and generate said device overlay and said bag labels.

* * * * *